US006960967B2

(12) United States Patent
Ando et al.

(10) Patent No.: US 6,960,967 B2
(45) Date of Patent: Nov. 1, 2005

(54) DIELECTRIC RESONATOR DEVICE, FILTER, DUPLEXER, AND COMMUNICATION APPARATUS

(75) Inventors: Masamichi Ando, Kyoto (JP); Kazuhiko Kubota, Muko (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 260 days.

(21) Appl. No.: 10/070,585

(22) PCT Filed: Jun. 26, 2001

(86) PCT No.: PCT/JP01/05439

§ 371 (c)(1),
(2), (4) Date: Jun. 5, 2002

(87) PCT Pub. No.: WO02/05377

PCT Pub. Date: Jan. 17, 2002

(65) Prior Publication Data

US 2002/0171509 A1 Nov. 21, 2002

(30) Foreign Application Priority Data

Jul. 10, 2000 (JP) ..... 2000-208916

(51) Int. Cl.[7] ..... H01P 1/20
(52) U.S. Cl. ..... 333/202; 333/134
(58) Field of Search ..... 333/202, 134, 333/206, 219.1, 219, 212, 222

(56) References Cited

U.S. PATENT DOCUMENTS 3,425,006 A 1/1969 Wolf
6,472,955 B2 * 10/2002 Saito et al. ..... 333/134

FOREIGN PATENT DOCUMENTS

| | | |
|---|---|---|
| CN | 1254965 A | 5/2000 |
| EP | 1001483 | 5/2000 |
| JP | 61-251207 | 11/1986 |
| JP | 62-118605 | 5/1987 |
| JP | 1-112607 | 7/1989 |
| JP | 122607/1989 | 8/1989 |
| JP | 5-64882 | 9/1993 |
| JP | 6-23048 | 6/1994 |
| JP | 6-80961 | 10/1994 |
| JP | 7-22887 | 4/1995 |
| JP | 7-142910 | 6/1995 |
| JP | 8-65017 | 3/1996 |
| JP | 8-181513 | 7/1996 |
| JP | 8-222905 | 8/1996 |
| JP | 9-51201 | 2/1997 |
| JP | 10-84201 | 3/1998 |
| JP | 10-224113 | 8/1998 |
| JP | 11-112204 | 4/1999 |
| JP | 2000-151229 | 5/2000 |
| WO | WO 00/14823 | 3/2000 |

OTHER PUBLICATIONS

Japanese Examination Report dated Dec. 24, 2003 (and English translation of same).

(Continued)

*Primary Examiner*—Peguy JeanPierre
*Assistant Examiner*—Joseph Lauture
(74) *Attorney, Agent, or Firm*—Dickstein, Shapiro, Morin & Oshinsky, L.L.P.

(57) ABSTRACT

Ceramic cavities 1*a* and 1*b* have upper and lower open faces and contain dielectric cores 2*a* and 2*b* formed integrally therein. The ceramic cavities 1*a* and 1*b* are sandwiched between upper and lower panels 3 and 4 at the upper and lower open faces, respectively, of the ceramic cavities 1*a* and 1*b* via grounding plates 5*a* and 5*b* and grounding plates 6*a* and 6*b*, respectively, and the upper and lower panels 3 and 4 are fixed by screws. Based on this structure, a problem of an unreliable joint part between an open face of a ceramic cavity and a metal panel connected directly to each other by soldering and the problem of increase of the number of components of a structure in which a printed circuit board is mounted to the open face of the ceramic cavity by using grounding plates can be overcome, even when the ceramic cavity has an open face formed in a complex shape.

11 Claims, 7 Drawing Sheets

OTHER PUBLICATIONS

Japanese Examination Report dated Sep. 30, 2003 (and English translation of same).
English abstract of JP 062–44611, date unknown.
English abstract of JP 63–266902, date unknown.
Supplementary European Search Report dated Apr. 29, 2004.
Copy of The People's Republic of China Office Action dated Jun. 4, 2004 (and English translation of same).

* cited by examiner

DIELECTRIC RESONATOR DEVICE, FILTER, DUPLEXER, AND COMMUNICATION APPARATUS

TECHNICAL FIELD

The present invention relates to dielectric resonant devices having cavities which contain dielectric cores, filters and duplexers using the dielectric resonant devices, and communication apparatuses using the filters and the duplexers.

BACKGROUND-ART

Hitherto, dielectric resonant devices have been used as filters and the like used in microwave bands, each dielectric resonant device having a ceramic cavity which has an open face, contains a dielectric core, and is provided with a conductive film, the cavity being covered by a metallic panel at the open face thereof.

In particular, a dielectric resonant device is disclosed in, for example, Japanese Unexamined Patent Application Publication Nos. 9-51201 and 8-222905, in which a metallic panel provided with a coupling loop and the like formed thereon and having a coefficient of linear expansion substantially the same as that of a material for resonator is directly connected by soldering to an electrode formed on an open face of a ceramic cavity. Another dielectric resonant device is disclosed in, for example, Japanese Unexamined Patent Application Publication Nos. 8-181513 and 8-65017, in which an open face of a ceramic cavity is covered by a printed circuit board provided with a coupling loop and the like formed thereon, and a conductive film of the ceramic cavity and the printed circuit board are connected to each other by soldering via a grounding plate therebetween, or the grounding plate is screwed to the substrate side.

However, a problem has been found in the above dielectric resonant device disclosed in Japanese Unexamined Patent Application Publication Nos. 9-51201 and 8-222905, in that since the thermal capacity of the ceramic cavity is large when the dielectric resonant device is large, a large temperature gradient is likely to be generated when soldering and a stress is applied to the joint part, whereby cracks causing breakages are easily produced in the joint part during use for a long time. The dielectric resonant device disclosed in Japanese Unexamined Patent Application Publication Nos. 8-181513 and 8-65017 requires a plurality of the grounding plates, thereby increasing the number of components and increasing manufacturing costs as a whole.

There is a problem in either dielectric resonant device of above, in that the manufacturing efficiency significantly decreases when the shape of the open face of the ceramic cavity is complex. The tendency toward the decrease of the efficiency is remarkable particularly when a regulated lead-free solder is used.

SUMMARY OF THE INVENTION

According to the present invention, a dielectric resonant device comprises a ceramic cavity having an open face and coated with a conductive film, the cavity containing a dielectric core; a conductive panel for covering the open face; and a resilient grounding plate sandwiched between the open face of the cavity coated with the conductive film and the conductive panel. The conductive panel is fixed to the cavity in such a manner as to be pressed thereto. The open face of the cavity and the conductive panel with the grounding plate therebetween which is connected to the conductive film formed on the open face of the cavity are brought into resilient contact with each other, whereby the problem of an unreliable contact part caused by soldering and the problem of an increased number of components and increased manufacturing costs due to the increased number of grounding plates are overcome, and manufacturing operations can be easily performed even when the shape of the open face of the cavity is complex.

According to the present invention, the grounding plate may be provided with projections which project in such a manner as to increase the thickness of the grounding plate in a direction of a gap between the conductive film provided on the open face and the conductive panel. With this arrangement, the overall grounding plate is provided with high resiliency by the projections in addition to the resiliency-which the material of the grounding plate has in itself, whereby superior electrical connection (grounding) can be maintained between the conductive film provided on the open face of the cavity and the conductive panel.

According to the present invention, the open face may comprise opposing first and second open faces of the cavity which are parallel to each other, and the conductive panel may comprise first and second panels for covering the first and second open faces, respectively, the first and second panels being fixed by screws. With this arrangement, a dielectric resonant device including the opposing two conductive panels, each provided with a coupling loop and the like, is obtainable. The cavity is not necessarily provided with a particular structure for mounting panels, and the panels can be mounted simply by fixing the panels to the cavity so as to sandwich the cavity.

The screws may be provided in a plurality of positions, at least some of the screws being disposed in the positions at which the screws pass through the inside of the cavity. With this arrangement, the overall size of the dielectric resonant device is prevented from increasing due to additional spaces for the screws.

The dielectric core in the cavity may be formed integrally therewith with two dielectric columns disposed perpendicular to each other so as to form a cross; the cross-section of sidewalls of the cavity, parallel to the open face of the cavity, is substantially uniform; the two dielectric columns are each provided with concavities formed in the sidewalls of the cavity and extending along the axis of the dielectric column; some of the screws are disposed inside the concavities and outside the cavity; and the other screws which are not inside the concavities are disposed inside the cavity. With this arrangement, the overall dielectric resonant device is prevented from being enlarged due to additional spaces for the screws passing outside the cavity.

According to the present invention, filter and duplexer individually comprise the dielectric resonant devices according to the present invention.

A communication apparatus comprises the filter or duplexer according to the present invention.

BEST MODE FOR CARRYING OUT THE INVENTION

Figure 1:
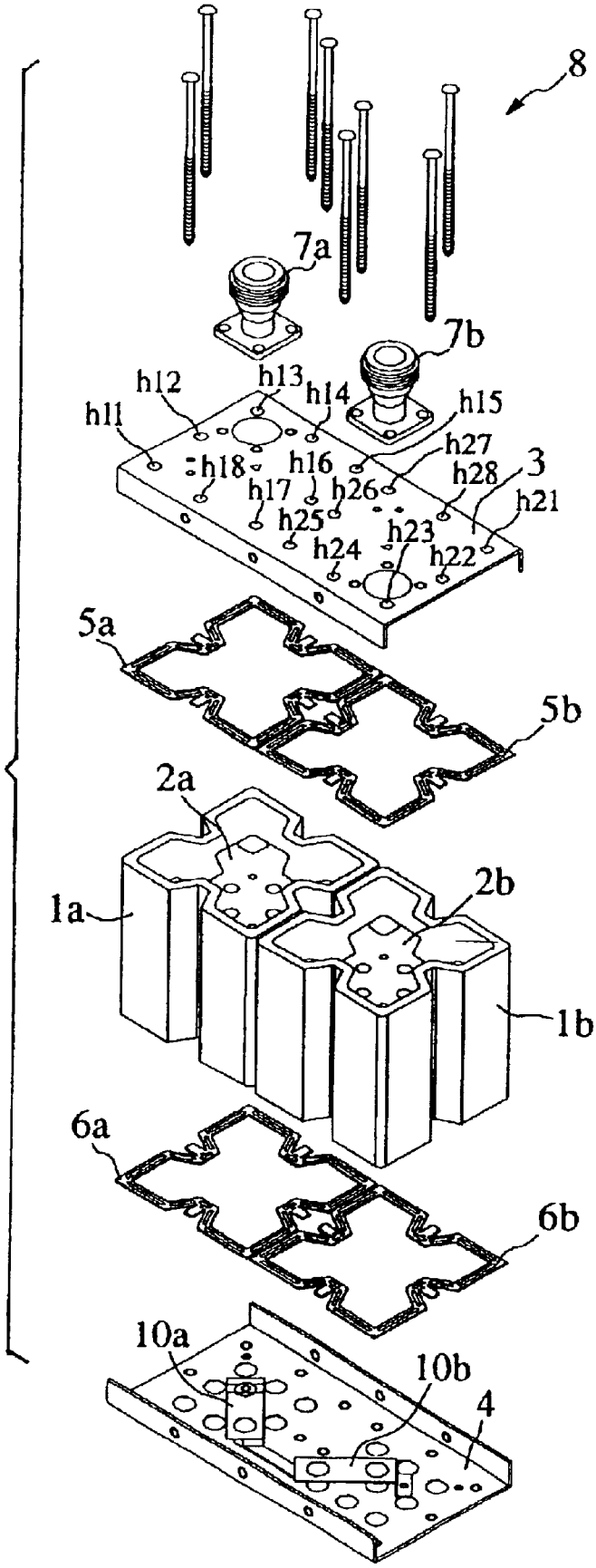
FIG. 1 is an exploded perspective view of dielectric resonant devices which form a filter according to a first embodiment of the present invention.
Figure 2:
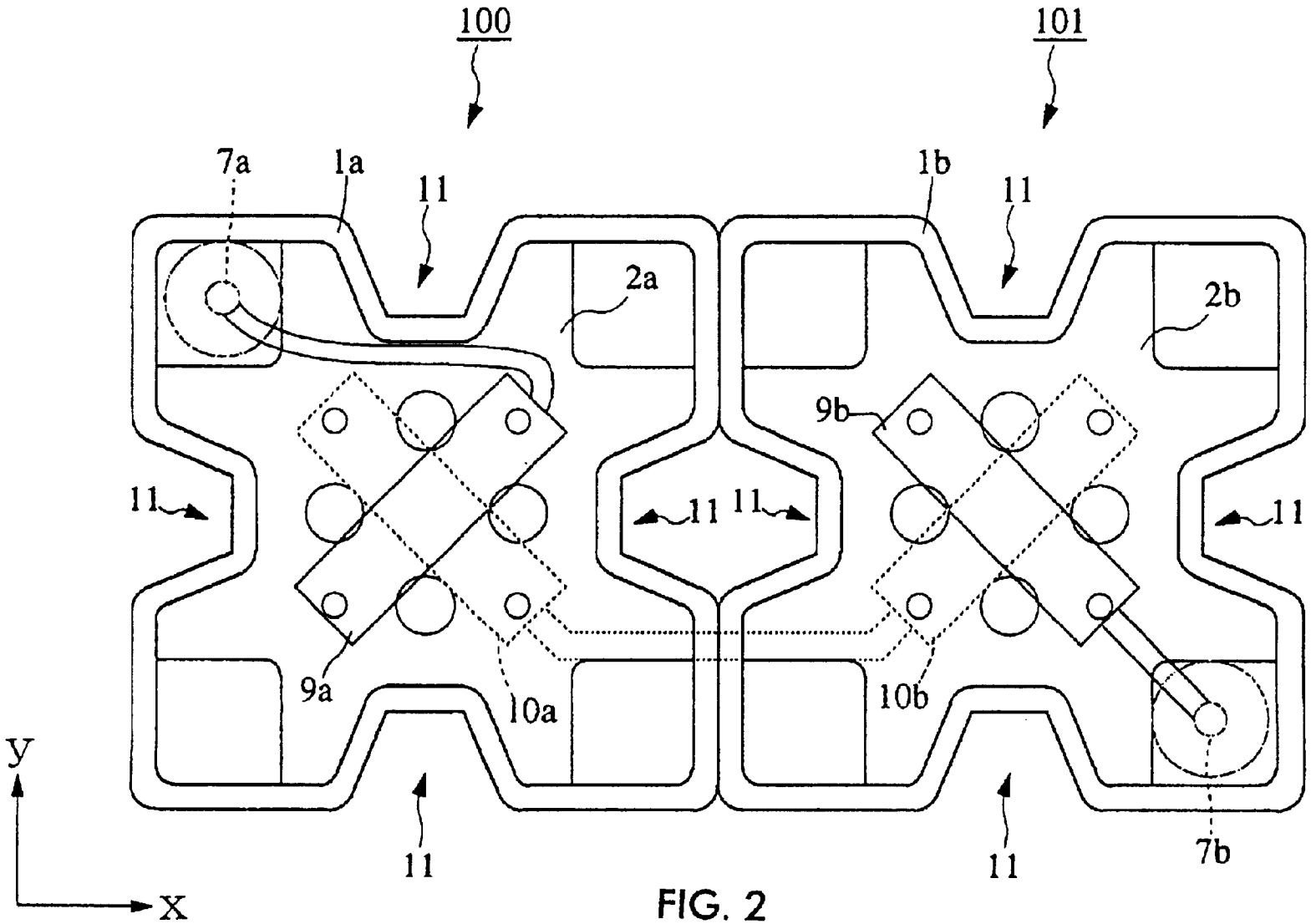
FIG. 2 is a top view of cavities of the dielectric resonant devices shown in FIG. 1, including input and output loops and coupling loops.

FIG. 1 is an exploded perspective view of a filter according to an embodiment of the present invention. In FIG. 1, numerals 1*a* and 1*b* represent dielectric-ceramic cavities of which top and bottom faces are open faces. Dielectric cores 2*a* and 2*b* are provided in the cavities 1*a* and 1*b*, respectively. The dielectric cores 2*a* and 2*b* are formed in the cavities 1*a* and 1*b*, respectively, integrally therewith. FIG. 2 is a top view of the cavities integrally provided with the dielectric cores.

In FIG. 1, numeral 3 represents an upper metal panel which covers the cavities 1*a* and 1*b* at the upper open faces thereof. Numeral 4 represents a lower metal panel which covers the cavities 1*a* and 1*b* at the lower open faces thereof. Numerals 5*a* and 5*b* represent grounding plates which are sandwiched between the upper open faces of the cavities 1*a* and 1*b* and the upper panel 3, and numerals 6*a* and 6*b* represent grounding plates which are sandwiched between the lower open faces of the cavities 1*a* and 1*b* and the lower panel 4. Numerals 7*a* and 7*b* represent coaxial connectors which serve as input-side and output-side connectors, respectively. Input and output loops are provided at the inner side (lower side in the drawing) of the upper panel 3, the input and output loops being formed between the central conductors of the coaxial connectors 7*a* and 7*b*, respectively, and the upper panel 3. Coupling loops 10*a* and 10*b* are mounted at a side (upper side in the drawing) of the lower panel 4 toward the cavities 1*a* and 2*a*.

As shown in FIG. 2, the dielectric cores 2*a* and 2*b* are integrally formed in the cavities 1*a* and 1*b*, respectively, each dielectric core 2*a* or 2*b* being formed with two dielectric columns crossing each other so as to form a cross, thereby forming a dielectric-core-integrated cavity unit as a whole. The cross-section of sidewalls of the cavity unit, parallel to the open faces of the cavity unit, is substantially uniform. Each cavity 1*a* or 1*b* is provided with concavities 11 formed in the sidewalls and extending along the axes of the dielectric columns. The cavities 1*a* and 1*b* are coated with conductive films which are Ag electrodes and the like at the sidewalls and the open faces of the cavities 1*a* and 1*b*.

In FIG. 1, the grounding plates 5*a* and 5*b*, the cavities 1*a* and 1*b*, and the grounding plates 6*a* and 6*b* are respectively sandwiched between the upper panel 3 and the lower panel 4 by using sixteen screws 8, some of which are omitted from the drawing so as to avoid complexity. The sixteen screws 8 respectively pass through holes h11 to h18 and h21 to h28 formed in the upper panel 3 and the corresponding holes formed in the lower panel 4. Four screws 8 passing through the holes h11, h13, h15, and h17 of the upper panel 3 pass through the inside of the cavity la, and four screws 8 passing through the holes h12, h14, h16, and h18 pass through the inside of the concavities 11, that is, the outside of the cavity 1*a*. Four screws 8 passing through the holes h21, h23, h25, and h27 pass through the inside of the cavity 1*b*, and four screws 8 passing through the holes h22, h24, h26, and h28 pass through the inside of the concavities 11. The screws 8 passing through the holes h13 and h23 of the upper panel 3 are also used for fixing the coaxial connectors 7*a* and 7*b*, respectively, to the upper panel 3.

When a conductor is provided in a cavity, conductance loss is generated on the surface of the conductor. However, when the screws 8 passing through the inside of the cavities 1*a* and 1*b* are plated with Ag, the conductance loss on the surface thereof can be sufficiently decreased, thereby suppressing decrease in a Qo-value of the resonator by 5 to 6 percent.

Figure 3:
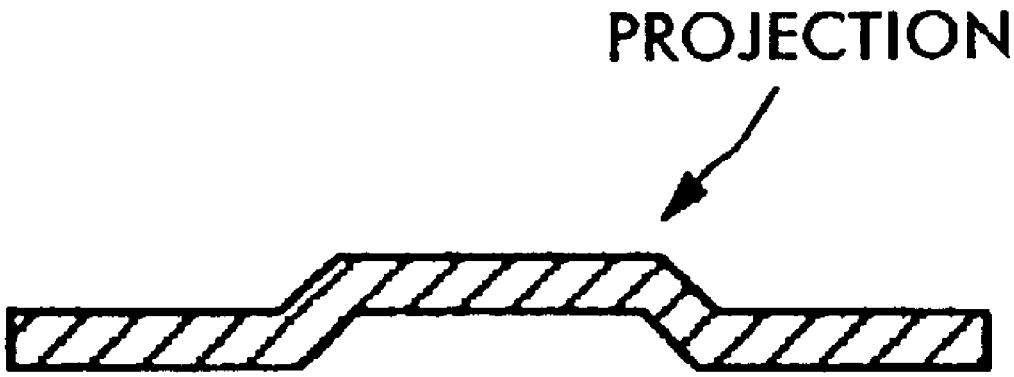
FIG. 3 is a partial sectional-view of a grounding plate used in the dielectric resonant device according to the first embodiment of the present invention.

FIG. 3 is a sectional view of a critical portion of each grounding plate 5*a*, 5*b*, 6*a*, or 6*b* shown in FIG. 1. The grounding plates 5*a*, 5*b*, 6*a*, and 6*b* are each formed in a frame having substantially the same shape as the outline of the open face of the cavity 1*a* or 1*b*. The grounding plate 5*a*, 5*b*, 6*a*, or 6*b* is provided with a plurality of projections which project in the thickness direction and extending along the frame. With this arrangement, the overall thickness of each grounding plate 5*a*, 5*b*, 6*a*, or 6*b* increases, and the resilient deformation in the thickness direction of the grounding plates 5*a*, 5*b*, 6*a*, and 6*b* is allowed to be increased. Therefore, when the upper and lower panels 3 and 4 are mounted on the upper and lower open faces, respectively, of the cavities 1*a* and 1*b* with the grounding plates 5*a* and 5*b*, and 6*a* and 6*b*, respectively, between the upper panel 3 and the cavities 1*a* and 1*b*, and the lower panel 4 and the cavities 1*a* and 1*b*, respectively, the upper and lower panels 3 and 4 are evenly brought into contact with the conductive films provided on the upper and lower open faces, respectively, of the cavities 1*a* and 1*b*, whereby a reliable grounding connection can be provided.

In FIG. 2, an input-output loop 9*a* is connected to a central conductor of the coaxial connector 7*a*, and an input-output loop 9*b* is connected to a central conductor of the coaxial connector 7*b*. The coupling loops 10*a* and 10*b* independently form loops with the lower panel 4. The coupling loop 10*a* forms a loop-plane perpendicular to the loop-plane formed by the input-output loop 9*a* and the upper panel 3, and the coupling loop 10*b* forms a loop-plane perpendicular to the loop-plane formed by the input-output loop 9*b* and the upper panel 3.

Modes used by the dielectric resonant device and the coupling between each mode are described below.

Figure 4:
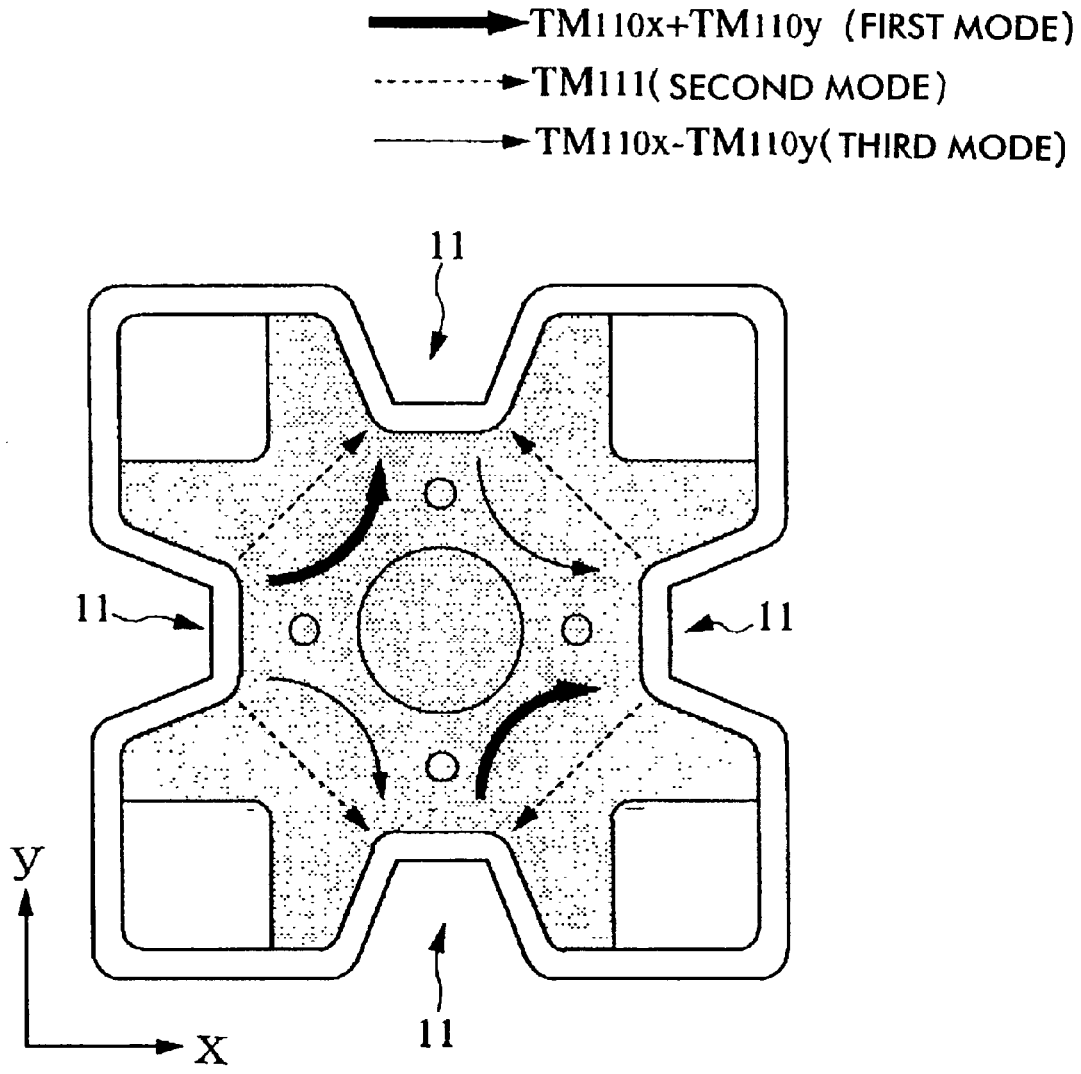
FIG. 4 is an illustration showing three resonant modes of the dielectric resonant device according to the first embodiment of the present invention.

FIG. 4 is a bottom view of the filter shown in FIG. 1 which is a dielectric-core-integrated cavity unit. In FIG. 4, the directions of electric-field vectors in a first mode (TM110x+TM110y mode), a second mode (TM111 mode), and a third mode (TM110x−TM110y mode) are schematically shown by thick-lined arrows, dotted-lined arrows, and thin-lined arrows, respectively. The frequency in the TM111 mode is made substantially the same as that in the TM110x+TM110y mode and TM110x−TM110y mode by providing the concavities 11.

Figure 5A:
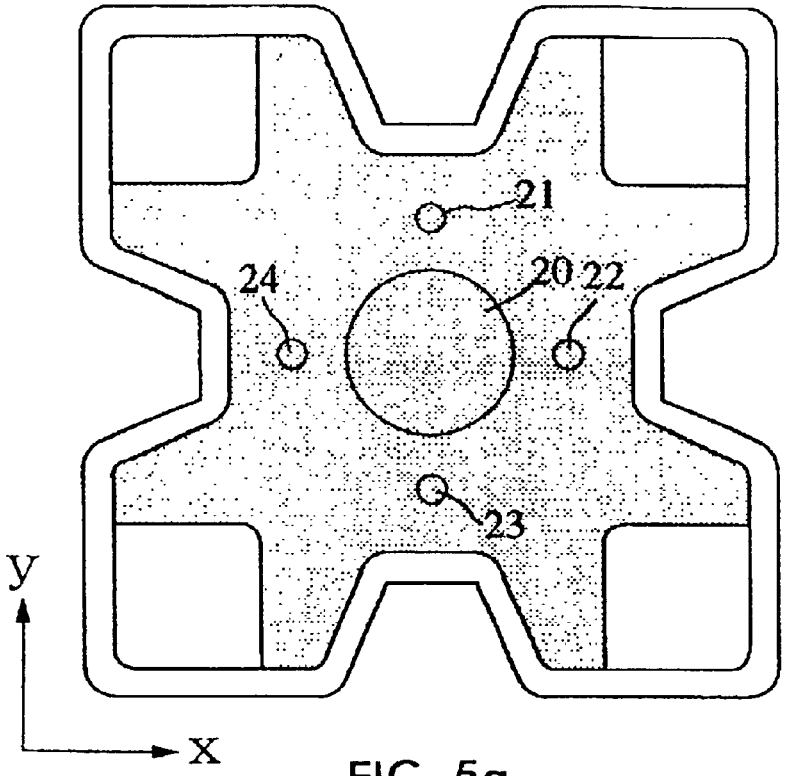
FIGS. 5*a* and 5*b* are illustrations showing a control for coupling the resonant modes and the control of the frequency, according to the first embodiment of the present invention.
Figure 5B:
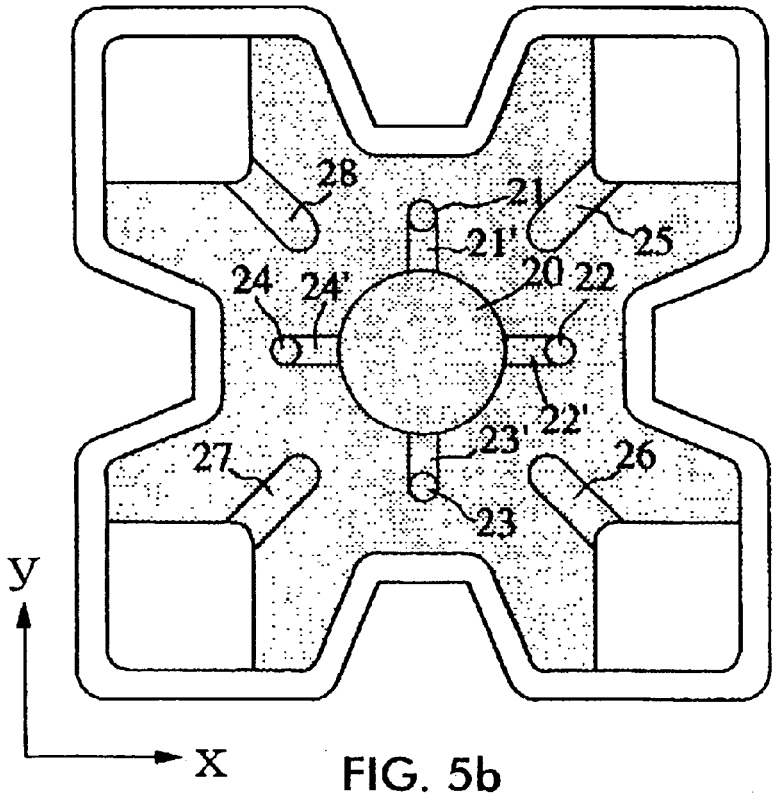

Both FIGS. 5*a* and 5*b* includes bottom views of a cavity, which show holes and grooves provided for controlling coupling between predetermined modes of the above three modes used by the dielectric resonant device and for controlling the frequency in each mode. FIG. 5(A) shows the cavity before tuning. In FIG. 5(B), grooves 28 and 26 having predetermined depths extend toward each other so as to have an angle of 45° from opposing corners of a dielectric core formed with two dielectric columns crossing each other in the x-y directions. By differing the sizes of the grooves 28 and 26 from each other, a perturbation is given to the distribution of field intensities of the first mode (TM110x+TM110y mode) and the second mode (TM111 mode), thereby coupling the first and second modes. In the same way, by differing the sizes of grooves 25 and 27, the second mode and the third mode (TM110x−TM110y mode) are coupled with each other. The coupling coefficient is controlled according to the difference.

Grooves 21' and 23' extending to a central hole 20 from holes 21 and 23, respectively, serve to vary the frequency in a TM110x mode which is a coupled mode of the first and third modes. Grooves 22' and 24' extending to the central hole 20 from holes 22 and 24, respectively, serve to vary the frequency in a TM110y mode which is another coupled mode of the first and third modes. The first and third modes are coupled with each other by the difference in depth between the grooves (21' and 23') and the grooves (22' and 24'), and the coupling coefficient is controlled according to the difference in depth.

The frequency in the first and third modes mainly varies in accordance with the depths of the grooves 21', 22', 23', and 24', the frequency in the first and second modes mainly varies in accordance with the depths of the grooves 28 and 26, and the frequency in the second and third modes mainly varies in accordance with the depths of the grooves 25 and 27. The effect of the grooves 21' to 24' on the frequency variation in the first and third modes differs from the effect of the same on the frequency variation in the second mode. Therefore, the grooves 21' to 24' are provided also for compensation for the frequency variation in the first, second, and third modes which is caused by the grooves 25, 26, 27, and 28 which are provided for coupling.

With reference to FIG. 2, the input-output loop 9*a* of a dielectric resonant device 100 couples with the first mode (TM110x−TM110y mode) and the coupling loop 10*a* couples with the third mode (TM110x+TM110y mode). The input-output loop 9*b* of a dielectric resonant device 101 couples with the third mode and the coupling loop 10*b* couples with the first mode. The first and third modes couple with each other indirectly via the second mode (TM111 mode) instead of directly coupling with each other because the first and third modes are perpendicular to each other. The dielectric resonant device shown in FIG. 1 functions as a filter having band-pass characteristics of six resonator-poles in which coupling is performed between the coaxial connectors 7*a* and 7*b* consecutively from the first, second, and the third modes of the dielectric resonant device 100, then, the first, second, and the third modes of the dielectric resonant device 101.

The upper and lower panels 3 and 4 are fixed to the cavities 1*a* and 1*b* by screws instead of soldering, whereby the assembly is made simple, thereby reducing the time and costs necessary for the manufacture. The disassembly can be performed easily during experiments and productions of prototypes; therefore, designing in a short time is possible.

Figure 6:
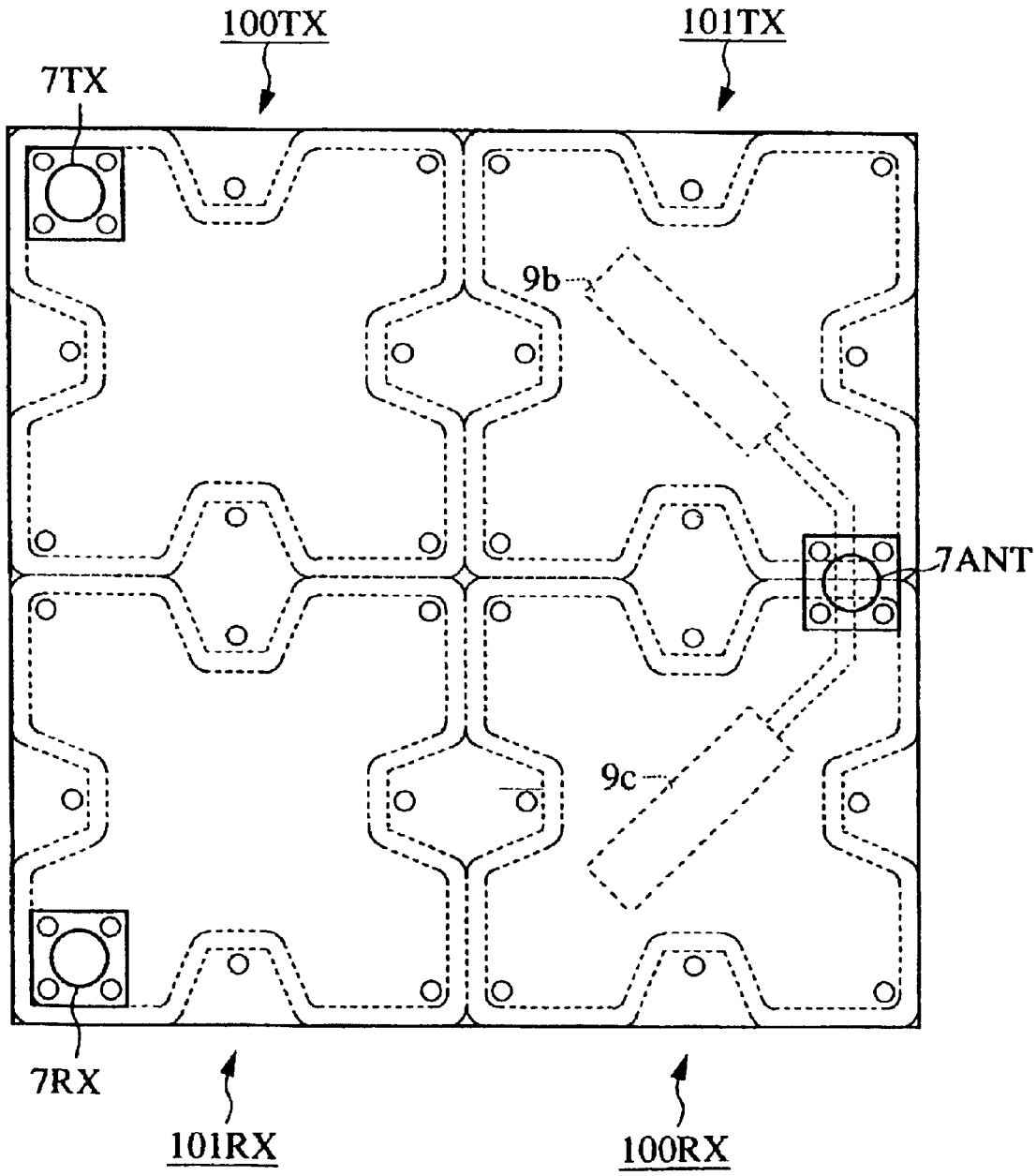
FIG. 6 is a top view of a duplexer according to a second embodiment of the present invention.

FIG. 6 is an illustration of a duplexer according to a second embodiment. The duplexer shown in FIG. 6 includes two sets of the filters, each including two dielectric resonant devices according to the first embodiment. FIG. 6 is a top view of the duplexer from an upper panel thereof. In FIG. 6, two dielectric resonant devices 100TX and 101TX form a transmitting filter, and other two dielectric resonant devices 100RX and 101RX form a receiving filter. The four dielectric resonant devices 100TX, 100TX, 100RX, and 101RX are integrated with each other by sandwiching cavities of the respective dielectric resonant devices 100TX, 101TX, 100RX, and 101RX with two upper and lower panels.

The filter formed with the dielectric resonant devices 100TX and 101TX and having six poles of resonators is basically the same as the filter according to the first embodiment except for that a coupling loop 9*b* coupling with the third resonator-pole of the dielectric resonant device 101TX, that is, the last resonator-pole of the transmitting filter is connected via a line to a coupling loop 9*c* coupling with the first resonator-pole of the dielectric resonant device 100RX, that is, the first resonator-pole of the receiving filter. A coaxial connector 7ANT as an antenna terminal is connected to a given point of the line at the central conductor of the coaxial connector 7ANT. Transmitting signals and received signals are branched from each other via the line.

Thus, the duplexer is formed with the transmitting filter including six resonator-poles and the receiving filter including six resonator-poles, and has a coaxial connector 7TX as a transmitting-signal-input terminal and a coaxial connector 7RX as a received-signal-output terminal.

As described above, the cavities and the panels are reliably connected to each other, and the number of components is reduced, thereby reducing manufacturing costs. When the open faces of the cavities have complex shapes, a dielectric filter or duplexer reduced in size and having predetermined characteristics can be provided by providing screws passing through the inside or outside of the cavities according to the shapes of the open faces of the cavities.

Figure 7:
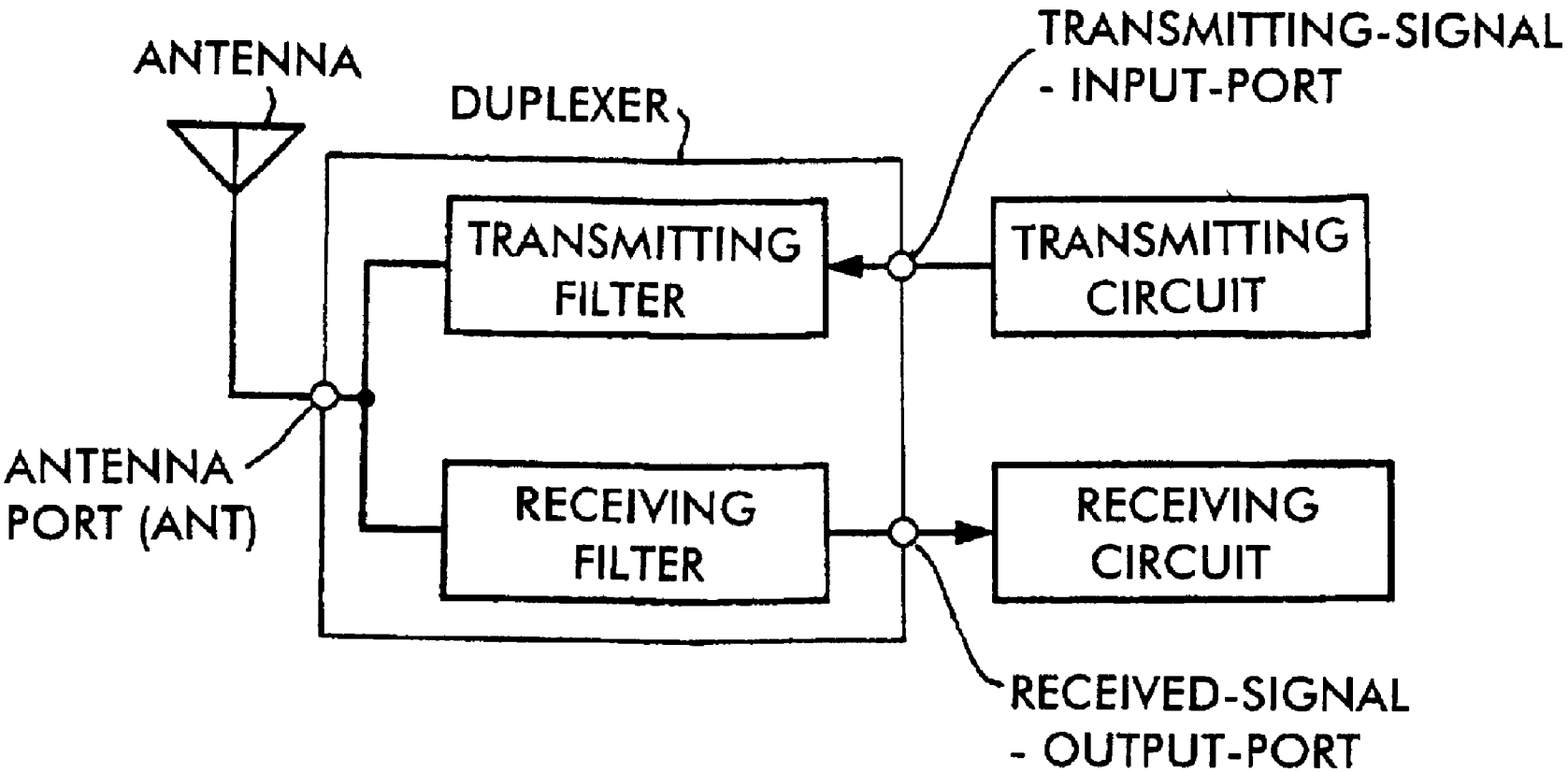
FIG. 7 is a block diagram of a communication apparatus according to a third embodiment of the present invention.

FIG. 7 is a block diagram of a communication apparatus according to a third embodiment of the present invention. A duplexer used in the communication apparatus includes a transmitting filter and a receiving filter. The duplexer has the configuration shown in FIGS. 5 and 6. In the duplexer, a transmitting-signal-input port is connected to a transmitting circuit, a received-signal-output port is connected to a receiving circuit, and an antenna port is connected to an antenna. The dielectric filter shown in FIGS. 1 to 5 may be provided at an output-part of the transmitting circuit and an input-part of the receiving circuit.

As described above, a communication apparatus reduced in overall size and weight is obtainable by using dielectric filters and/or dielectric duplexers reduced in size in which the cavities and the panels are reliably connected to each other, the number of components is reduced, thereby reducing manufacturing costs, and predetermined characteristics are obtained.

According to the present invention, the problem of an unreliable contact part caused by soldering and the problem of an increased number of components and increased manufacturing costs due to the increased number of grounding plates are overcome, and manufacturing operations can be easily performed even when the shape of the open face of the cavity is complex.

The grounding plates are each provided with projections which project in such a manner as to increase the thickness of the grounding plate in a direction of a gap between the conductive film provided on the open face and the conductive panel. Therefore, the grounding plates are provided with high resiliency in the thickness direction of the grounding plates, whereby superior electrical connection (grounding) can be maintained between the conductive films provided on the open faces of the cavity and the conductive panels.

By fixing first and second panels to each other, for covering the first and second open faces, respectively, opposing substantially parallel to each other of the cavity by screws, a dielectric resonant device including the opposing two conductive panels, each provided with a coupling loop and the like, is obtainable. The cavity is not necessarily provided with a particular structure for mounting panels, and the panels can be mounted simply by fixing the panels to the cavity so as to sandwich the cavity.

At least some of the screws provided in a plurality of positions are disposed in the positions at which the screws pass through the inside of the cavity, whereby the overall size of the dielectric resonant device is prevented from increasing due to additional spaces for the screws.

The dielectric columns are provided with concavities formed in the sidewalls of the cavity and extending in a direction of two axes of the dielectric columns and some of the screws passing outside the cavity are not disposed in enlarged spaces formed toward the outside of the cavity, whereby the overall dielectric resonant device is prevented from being enlarged. Moreover, the panels are pressed to the open faces of the cavity by the screws disposed inside the cavity and the screws disposed outside the cavity, whereby a bending stress is not likely to be applied to the panels, thereby maintaining the flatness of the open faces of the cavity. Therefore, a risk of variations in the frequency characteristics according to the screwing torque can be avoided.

INDUSTRIAL APPLICABILITY

As is obvious from above description, the dielectric resonant device, filter and duplexer of this invention can be applied to, for example, communication apparatuses to be included in base stations for cellular phone system.

What is claimed is:

1. A dielectric resonant device comprising:

a ceramic cavity having an open face and coated with a conductive film, the cavity containing a dielectric core;

a conductive panel for covering the open face; and a resilient grounding plate sandwiched between the open face of the cavity coated with the conductive film and the conductive panel, wherein the conductive panel is fixed to the cavity in such a manner as to be pressed thereto.

2. A dielectric resonant device according to claim 1, wherein the grounding plate is provided with projections which project in such a manner as to increase the thickness of the grounding plate in a direction of a gap between the conductive film provided on the open face and the conductive panel.

3. A dielectric resonant device according to one of claims 1 and 2, wherein the open face comprises opposing first and second open faces of the cavity which are parallel to each other, and the conductive panel comprises first and second panels for covering the first and second open faces, respectively, the first and second panels being fixed by screws.

4. A dielectric resonant device according to claim 3, wherein the screws are provided in a plurality of positions, at least some of the screws being disposed so as to pass through the inside of the cavity.

5. A dielectric resonant device according to claim 3, wherein a film of silver is disposed on the surface of the screws.

6. A dielectric resonant device according to claim 3, wherein the dielectric core in the cavity is formed integrally therewith with two dielectric columns disposed perpendicular to each other so as to form a cross; the cross-section of sidewalls of the cavity, parallel to the open face of the cavity, is substantially uniform; the two dielectric columns are each provided with concavities formed in the sidewalls of the cavity, the concavities extending along an axis of the dielectric column; some of the screws are disposed inside the concavities and other screws are disposed inside the cavity.

7. A dielectric resonant device according to claim 4, wherein a film of silver is disposed on the surface of the screws.

8. A dielectric resonant device according to claim 4, wherein the dielectric core in the cavity is formed integrally therewith with two dielectric columns disposed perpendicular to each other so as to form a cross; the cross-section of sidewalls of the cavity, parallel to the open face of the cavity, is substantially uniform; the two dielectric columns are each provided with concavities formed in the sidewalls of the cavity, the concavities extending along an axis of the dielectric column; some of the screws are disposed inside the concavities and other screws are disposed inside the cavity.

9. A filer comprising:

a dielectric resonant device according to claim 1, wherein the conductive panel is provided with input-output loops.

10. A duplexer comprising:

at least two filters, each of the at least two filters comprising a filter according to claim 9, wherein either the input-output loops coupling with resonant modes in two resonant regions among a plurality of resonant regions of the cavities containing the dielectric cores or electrodes coupling with the input-output loops are led to the outside as input-output units for a common antenna.

11. A communication apparatus comprising:

a filter according to claim 9 or a duplexer according to claim 10.

* * * * *